US005311621A

United States Patent [19]

Tung

[11] Patent Number: 5,311,621

[45] Date of Patent: May 17, 1994

[54] SHOWER UNIT

[75] Inventor: Ming B. Tung, London, United Kingdom

[73] Assignee: British Gas PLC, London, United Kingdom

[21] Appl. No.: 887,373

[22] Filed: May 21, 1992

Related U.S. Application Data

[63] Continuation of Ser. No. 611,675, Nov. 13, 1990, abandoned.

[30] Foreign Application Priority Data

Nov. 13, 1989 [GB] United Kingdom ..... 8925601

[51] Int. Cl.[5] ..... B05B 1/00

[52] U.S. Cl. ..... 4/615; 239/430; 4/676

[58] Field of Search ..... 4/192, 567, 568, 570, 4/601, 615, 676, 677, 678; 239/430

[56] References Cited

U.S. PATENT DOCUMENTS

| | | | |
|---|---|---|---|
| 1,438,999 | 12/1922 | Hoxe | 239/430 X |
| 2,210,846 | 8/1940 | Aghnides | 239/430 X |
| 3,539,111 | 11/1970 | Johnson . | |
| 3,614,244 | 10/1971 | Eck . | |
| 3,651,523 | 3/1972 | Miyahara et al. | 4/192 |
| 4,121,773 | 10/1978 | Headen et al. . | |
| 4,174,822 | 11/1979 | Larsson | 4/615 X |
| 4,295,612 | 10/1981 | Betsinger et al. . | |
| 4,322,036 | 3/1982 | Bly . | |
| 4,358,056 | 11/1982 | Greenhut et al. . | |
| 4,,394,969 | 7/1983 | Jette . | |

FOREIGN PATENT DOCUMENTS

| | | | |
|---|---|---|---|
| 3531295 | 3/1987 | Fed. Rep. of Germany | 4/192 |
| 771234 | 10/1934 | France | 4/192 |
| 1178855 | 9/1985 | U.S.S.R. | 4/192 |
| 443081 | 3/1936 | United Kingdom . | |
| 587693 | 5/1947 | United Kingdom | 4/192 |
| 754978 | 8/1956 | United Kingdom . | |
| 1264907 | 2/1972 | United Kingdom . | |
| 2189843 | 11/1987 | United Kingdom . | |
| 2191245 | 12/1987 | United Kingdom . | |
| 8404059 | 10/1984 | World Int. Prop. O. . | |

*Primary Examiner*—Charles E. Phillips

*Attorney, Agent, or Firm*—Oblon, Spivak, McClelland, Maier & Neustadt

[57] ABSTRACT

A shower unit 1 comprises a mixing chamber 2 having an inlet 7 for hot water, an inlet 27 for cold water, a jet or nozzle 5 connected to the inlet 27 for causing the cold water and to entrain the hot water to form a mixture for discharge from the chamber 2 to a shower head or rose 6 which forms an integral part of the unit.

7 Claims, 4 Drawing Sheets

SHOWER UNIT

This application is a continuation of application Ser. No. 07/611,675, filed on Nov. 13, 1990, now abandoned.

BACKGROUND OF THE INVENTION

1. Field of the Invention

The present invention relates to a shower unit and particularly, though not exclusively, to a shower unit in which the hot water is gas heated.

2. Discussion of the Background

Gas heated hot water offers a relatively inexpensive source of sanitary water for domestic consumption e.g. for showering, bathing, dishwashing and other applications requiring hot water.

In many gas heated hot water systems, the heated water is stored in a hot water storage tank (a so-called cylinder) before it is distributed in a piped system to a point or points of usage. At the point of usage for instance a hot water tap, the hot water is discharged into an open vessel such as a bath or sink. The amount of hot water discharged is regulated by the hot water tap, the maximum flow rate of the water through which being controlled by such parameters as the pressure difference between the cold water supply cistern and the tap and the flow resistance in the piping arising from frictional and throttling losses caused by sudden changes of flow area or flow direction.

Conventional gas heated hot water shower systems are similarly designed in the manner described above except that the shower outlet is supplied with both hot and cold water from a mixing chamber incorporating a mixing valve to regulate the temperature of the water delivered by the shower head. In this case the hot and cold water are supplied separately from the same initial source, namely a cold water supply cistern, some water being heated for storage as hot water in the cylinder before delivery to the mixing valve. Owing to the need for a mixing valve, the amount of hot water discharged at the shower head is limited by the flow restrictions at the mixing valve and at the shower head in which a number of relatively small openings are provided to produce the showering effect.

Customer satisfaction with any shower system appears mainly to depend upon the pressure of delivery of the water at the shower head. In the cases where the flow resistance in the system is relatively high the water pressure at the supply point of a gas heated hot water system (i.e. the cylinder outlet) may be insufficient to overcome the resistance at the shower head and this may lead to a situation where the water flow through the shower head is below the satisfactory level demanded by the customer.

This problem can be overcome by the insertion of an electrically powered shower booster pump between the shower head and the cylinder outlet. The booster pump raises the pressure head of the hot water supply to such a level that it can produce a powerful shower well beyond the pressure level provided by any gravity feed system.

Such booster pumps are relatively expensive and can make such gas heated shower systems economically unattractive to the average customer.

GB Patent Specification Nos. 1570484 (Anderson), 1581724 (Wilson), and 2190022A (Pringle) all disclose shower units which are designed to obviate the need for a booster pump. In general these types of shower units comprise a mixing chamber of the type having one inlet for connection to a supply of hot water, another inlet for connection to a supply of cold water and a nozzle or jet connecting the cold water inlet to the chamber and adapted to cause the cold water to entrain the hot water to form at least a partial mixture for discharge from the chamber to a shower head or rose.

In use the cold water is supplied at mains pressure which is more than adequate to provide entrainment of the hot water and subsequent adequate delivery pressure from the shower head.

In these units the mixing chamber is connected to the shower head by means of a pipe, usually of a flexible kind, to permit the height of the shower head to be varied.

The provision of a pipe increases the overall cost of the unit and, moreover, tends to increase the length of the flow path from the nozzle to the shower head leading to an increase in frictional effects and a consequent reduction in the suction effect of the faster moving cold water jet on the slower moving hot water stream.

SUMMARY OF THE INVENTION

It is therefore an object of the present invention to provide a shower unit of the type defined reducing the above disadvantages.

According therefore to the present invention we provide a shower unit comprising a mixing chamber of the type in which hot water supplied to the chamber can be entrained by cold water supplied to the chamber to form at least a partial mixture for discharge from the chamber to a shower head, the shower head being connected directly to the chamber.

Preferably the shower head is an integral part of the unit.

Thus in this way the usual pipe for connecting the chamber to the shower head can be dispensed with, leading to a reduction in the cost of the unit and in the length of the entrained water flow path.

By reducing the required length of the entrained water flow path it is then possible to reduce the diameter of the mixing chamber and therefore provide a more compact unit but without adversely reducing the entrainment rate of the unit (i.e. the amount of the relatively low pressure hot water entrained by the relatively high pressure cold water stream).

Suitably means are provided for adjusting the height of the chamber and therefore the height of the shower head or rose.

Conveniently the entrainment is effected by means of at least one tapered jet or nozzle through which, in use, the cold water is injected into the chamber. It is therefore envisaged that two or more such jets or nozzles could be incorporated within the unit.

Preferably a first valve means is provided for controlling the flow rate of hot water to the mixing chamber and a second valve means is provided for controlling the flow rate of cold water to the mixing chamber.

Suitably the second valve means is also adapted to control the flow rate of hot water.

Conveniently the valve means are contained within a single body.

The first and second valve means may be incorporated within the body containing the mixing chamber.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

Figure 1:
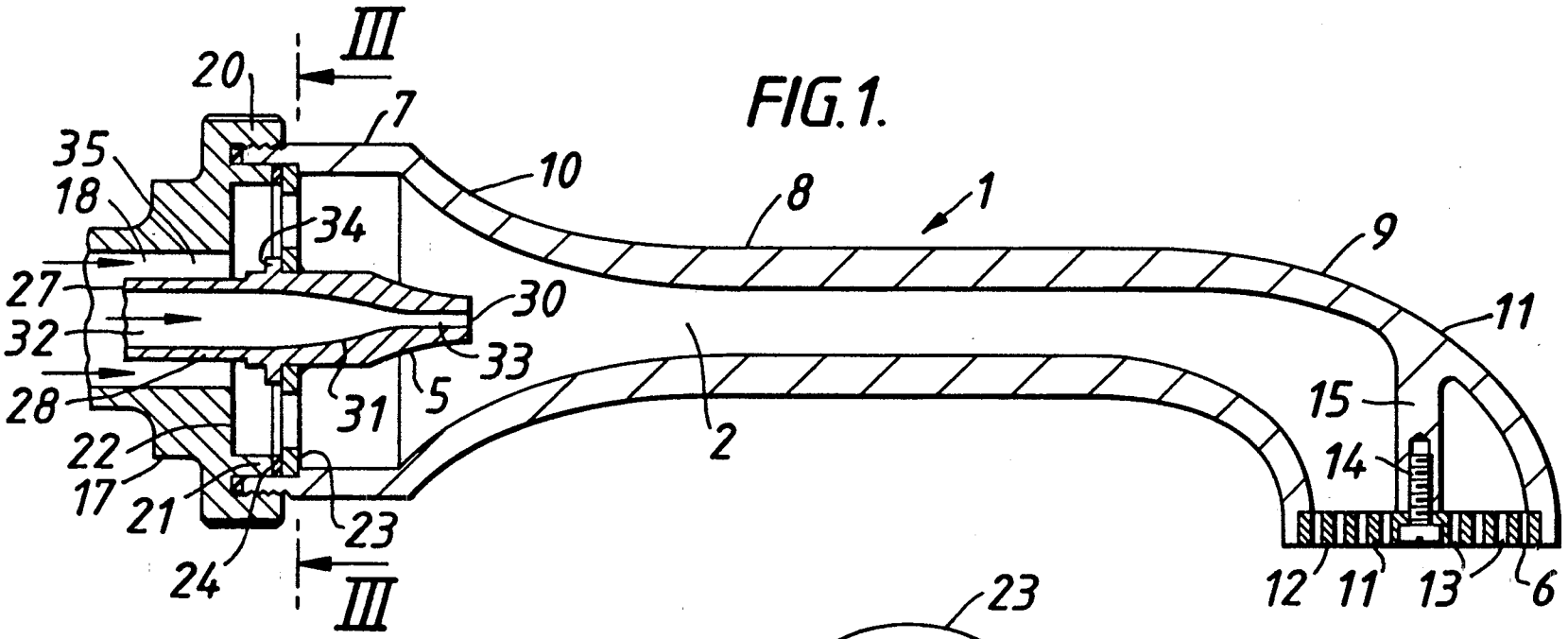
FIG. 1 is a side view in section of one embodiment of the shower unit.
Figure 2:
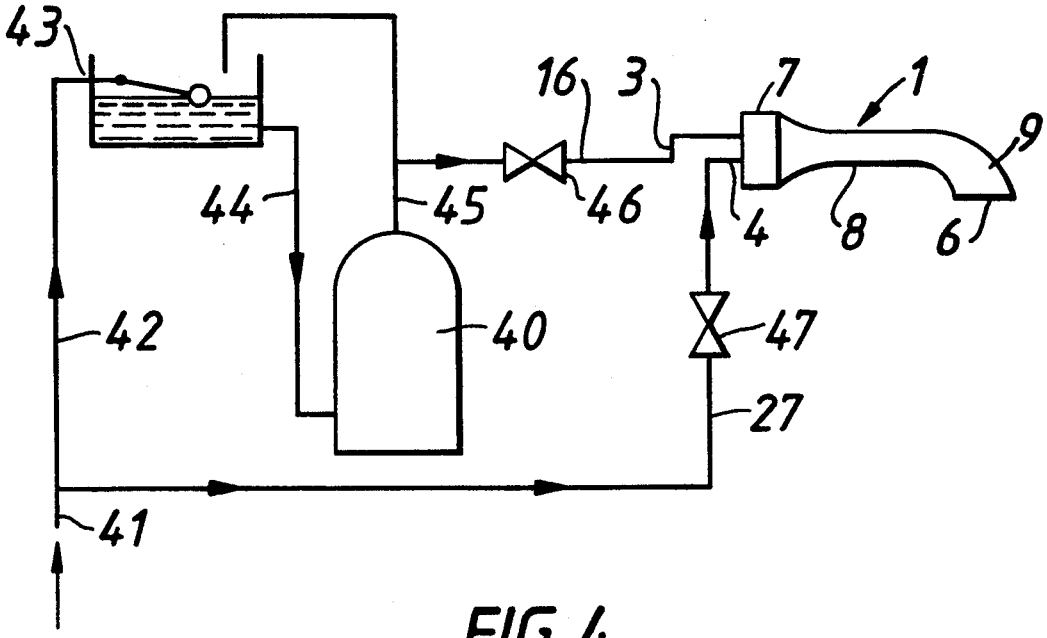
FIG. 2 is a schematic arrangement of the unit and water supply systems.

Referring to FIGS. 1 and 2 the shower unit comprises a body 1 incorporating a mixing chamber 2 in which hot and cold water are mixed, there being a supply means 3 for supplying hot water to the chamber 2, a supply means 4 for supplying cold water to a tapering jet or nozzle 5 within the chamber 2 to entrain the hot water and the body 1 having an integral shower head or rose 6 from which the mixture is discharged.

The body 1 takes the form of a duct of generally circular cross section having a rearward hot water inlet section 7 forming a settling chamber for the hot water, a central section 8 incorporating the mixing chamber 2 and a forward outlet section 9 incorporating the shower head 6 which forms an integral part of the body thus dispensing with a connecting pipe.

The inlet section 7 is in the shape of a hollow cylinder which leads into the central section 8 by means of inwardly tapering part 10. Otherwise the central section 8 is in the form of a hollow elongate cylinder.

The central section 8 leads into the forward shower head 6 by means of a downwardly turning but outwardly tapering part 11 which terminates in an outlet plate 12. The outlet plate 12 is circular and has a number of small diameter openings 13 therein, the plate 12 being received within a recess in the end of the outlet section 6. The plate 12 is affixed by means of a screw 14 to a cylindrical lug 15 depending from the internal wall of the part 11 so that the plate 12 can be detached for cleaning purposes. Depending on requirements the openings 13 can range from 0.5 mm to 3 mm in diameter and of course there can be any number depending on requirements although the greater the total area of the openings the greater the delivery rate of course.

The inlet end 7 of the body 1 is connected to a hot water inlet pipe 16 (shown schematically in FIG. 3 as part of the hot water supply means) by means of a connector device 17, the front end of which is shown in FIG. 1.

The connector 17 has a central bore 18 extending therethrough, the other end of which is either directly connected to the hot water inlet pipe 16 in a manner not shown or is preferably connected to the inlet pipe 16 indirectly by means of the unit shown in FIG. 4 and to be subsequently described.

The connector 17 has an annular recess formed between outermost and innermost annular projecting portions 20 and 21, respectively, on the end face 22 of the connector 17 to receive by screw threaded engagement an end portion of the inlet section 7. The duct section 7 itself is provided with an internal annular recess adjacent its end within which in use is seated the perforated hot water distribution plate 23 shown in detail in FIG. 3. The plate 23 is held in position by means of an O-ring 24 of a resilient material such as rubber which forms a seal with the plate 23 when the end portion of the duct section 7 is screwed into the recess in the end face of the connector 17, the projecting portion 21 engaging and compressing the O-ring 24 against the plate 23.

The plate 23 has a central aperture 25 for the purpose to be described and a number (in this case eight) of further hot water distribution apertures 26 arranged in a circular array around the central aperture 25.

The cold water supply means comprises a cold water inlet pipe 27, a forward portion 28 of which is shown in FIG. 1. The inlet pipe 27 extends at least in part coaxially with the bore 18 of the connector 17 as shown in FIG. 1.

The inlet pipe 27 terminates in a nozzle or jet 5 which in use extends through the central aperture 25 of the plate 23 and through the section 7 of the body 1 with which section the jet 5 is coaxially located. The jet 5 itself terminates in an outlet aperture 30 located within the tapering portion 10 of the body 1. The jet 5 has a throat 31 which tapers inwardly from a point adjacent the bore 32 of the inlet pipe 27 to form a smaller constant area outlet bore 33 terminating in the outlet aperture 30.

The inlet pipe 27 is formed with an external annular rib 34 effectively separating the inlet pipe 27 from the jet 29, the rib 34 in use abutting against the plate 23 to hold the pipe 27 in position.

Figure 4:
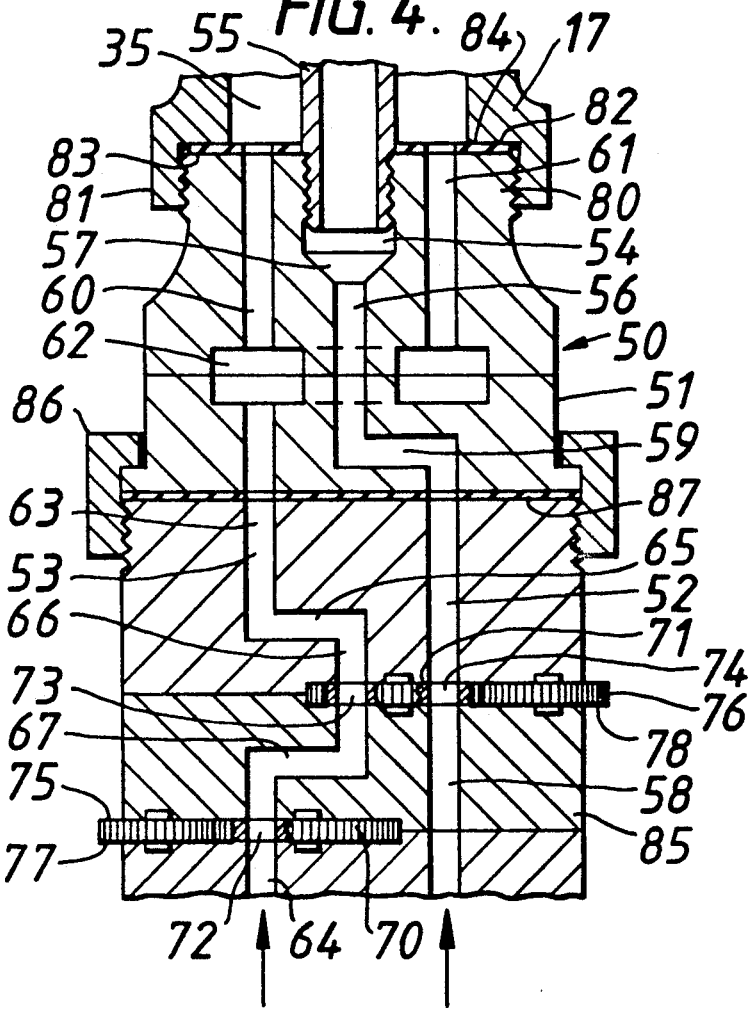
FIG. 4 is a sectional view through a unit incorporating in a single body the separate control valves shown in FIG. 3.

The cold water inlet pipe 27 has a rearward portion which is either directly connected to the source of cold water as shown in FIG. 2 in a manner not shown or is preferably connected to the source indirectly by means of the unit shown in FIG. 4. It will be appreciated that in use the hot water will at least in part be supplied to the inlet end 7 of the body 1 by way of the annular chamber 35 formed between the external wall of the inlet pipe 27 and the wall of the connector bore 18.

In use of the shower unit, hot water enters the inlet end 7 of the duct 1 which end 7 serves as a hot water inlet supply chamber for the mixing chamber 2. In the mixing chamber 2, the hot water meets the jet of cold water ejected from the outlet 30 of the jet 5. The cold water is accelerated as it passes along the throat section 31 of the jet 5 which throat is so designed that the static pressure of the cold water leaving the outlet 30 is no more than and is preferably less than the static pressure of the hot water in the inlet chamber end 7 of the shower unit 1. This prevents the cold water forcing the hot water back along the annular chamber 35 to the source of hot water. Of course the original static mains pressure will have now been nearly all converted into a dynamic pressure jet stream of cold water serving to entrain the hot water in the mixing chamber 2.

Referring to FIG. 2 the source of hot water comprises a hot water storage tank or cylinder 40 and the source of cold water is a cold water mains supply 41. The mains supply 41 has one outlet serving as the cold water inlet pipe 27 leading to the jet 5. The other outlet 42 supplies water direct to the usual cold water storage tank or cistern 43. The cistern 43 supplies cold water on demand by gravity feed to the cylinder 40 by a pipe 44.

This water is heated inside the cylinder 40 by means of an internal calorifier (not shown) as conventional. The hot water is then supplied on demand by the cylinder 40 to the shower unit 1 by way of outlet pipes 45 and 16 to the bore 18 of the connector 17 and thence to the inlet end 7 of the duct 1. Clearly to provide a gravity feed of hot water from the cylinder 40 to the duct 1, the duct 1 must be located below the cistern 43 to provide the necessary pressure head.

The flow rates of the hot and cold water may be controlled by regulating valves 46 and 47 located in each of the lines 16 and 27 respectively.

The cold water mains pressure may be as little as 1 bar although a high mains pressure is preferred to provide a higher water discharge rate.

The pressure of the hot water entering the inlet chamber 7 of the unit 1 is obviously dependent upon the height differential between the cistern 43 and the shower unit 1. Preferably this should be as large as possible to provide the necessary pressure head for the hot water arriving at the shower unit 1.

In domestic dwellings this height difference may vary between as little as 0.5 m (giving a pressure head of approximately 0.05 bar) to as much as perhaps 5 meters in exceptional circumstances (giving a pressure head of approximately 0.3 bar).

Whatever is the situation the cold water jet in the shower head must be designed to reduce the mains pressure, which will inevitably be higher than the hot water pressure head, to a level which is no more than that of the hot water pressure head and preferably is less than the hot water pressure.

In the most usual type of dwelling, for example a two story house, the shower head will be situated in the bathroom on the top floor and the cistern in the attic possibly some 2 meters above the shower head to provide a pressure head of approximately 0.2 bar.

In this type of dwelling, the mains pressure will be around 2 bar and so the jet will need to reduce this pressure to no more than 0.2 bar.

In those circumstances we have found that our shower head is able to deliver a water mixture at a rate greater than 10 liters/minute. This compares with delivery rates of only 4 liters/minute with the prior art electrically pumped showers.

With the hot water being supplied from the cylinder at 60° C. and cold water at 10° C., the discharge temperature was approximately 40° C. which is quite acceptable to users.

Figure 3:
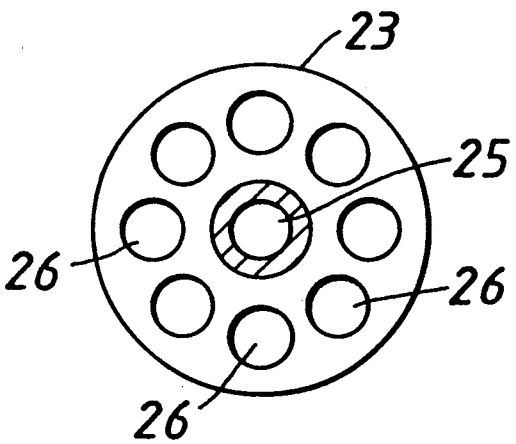
FIG. 3 is a view in the direction of the arrows of FIG. 1 of a hot water inlet distribution plate for the unit.

Referring to FIG. 4 the separate regulating valves 46 and 47 shown in the schematic version in FIG. 3 have here been consolidated into one valve system 50.

The system 50 comprises a generally elongate cylindrical body 51 through the length of which extends a first channel 52 for cold water and a separate second channel 53 for hot water.

The first channel 52 has a lowermost inlet end (not shown) for connection to an outlet from the cold water mains supply. This channel 52 also has an uppermost outlet end 54 which has a greater diameter than the remainder of the channel 52. The outlet end 54 of the channel also has a wall which is internally threaded to receive a corresponding threaded end of the rear portion 55 of the inlet pipe 27 shown in FIG. 1. The outlet end 54 of channel 52 is joined to an upper part 56 of channel 52 by an inwardly tapering portion 57. As can be seen the outlet end 54, tapering portion 57 and upper part 56 of the channel 52 are all located coaxially within the body 51 while the lower part 58 of the channel 52 is offset from but is parallel to the axis of the body 51. The lower part 58 adjoins the upper part 56 by means of a further radially directed intermediate part 59.

The second channel 53 has a lowermost inlet end (not shown) for connection to the outlet from the hot water cylinder. Channel 53 has two uppermost outlet ends 60 and 61 leading into the annulus 35 formed between the outer wall of the inlet pipe 27 and the wall of the bore 18 formed in the connector 17. The ends 60 and 61 lead off from an annular chamber 62 which circumvents the upper part 56 of the channel 52, the throat-area of the chamber 62 being greater than the throat area of the remainder of the channel 53.

Leading downwardly from the chamber 62 is a further part 63 of the channel 53. This part 63 is off set from the axis of the body 51 as shown. A lowermost part 64 of the channel 53 is arranged parallel to the part 63 and is joined thereto by means of three further parts 65,66 and 67. Part 66 is as shown coaxial with the unit 50 and adjoins part 63 by the radially outwardly directed part 65 and part 64 by a radially outwardly directed part 67.

The flow rate of hot water through the channel 53 is controlled by means of circular plates 70 and 71 serving as regulating valves. Plate 71 also controls the flow rate of cold water through the channel 52.

Each plate 70,71 is rotatably mounted within recesses within the body 51.

The surface of plate 70 overlaps the lower part 64 of channel 53 while the surface of plate 71 overlaps the part 66 of channel 53 as well as the lower part 58 of channel 52.

Each plate 70 and 71 is provided with a slot 72 and 73 respectively which upon rotation to a suitable position permit the flow of hot water through the plates, the flow rate being varied by the position of the slot relative to the channel 53. In addition plate 71 is provided with a further slot 74 which upon rotation to a suitable position permits the flow of cold water through the plate 71, the flow rate being varied by the position of the slot relative to the channel 52.

Each plate 70,71 has a toothed rim for engagement with a toothed rim of a corresponding thumb wheel 75,76 partly mounted in recesses within the body 51 whereby each plate 70,71 can be rotated by suitable rotation of the corresponding thumb wheel 75,76. Each wheel 75,76 has edges 77,78 each of which respectively project beyond the wall of the body 51 to permit the consumer to rotate the thumb wheel to the desired setting.

Since the temperature of the water leaving the shower head has been found to be primarily dependent upon the hot water flow rate, plate 70 acts effectively as the water temperature controller and its corresponding thumb wheel 75 may accordingly carry suitable temperature settings.

Regarding plate 71, the slots 73 and 74 are so arranged that at the closed position of cold water slot 73, the cold water slot 74 is also closed. At any other position of slot 74, slot 73 is fully open to allow a full flow of hot water. Consequently the second plate 71 serves only as means for controlling the flow rate of water through the shower head leaving the first plate 70 to control the flow temperature.

In action, the consumer will first adjust the position of the first plate 70 to achieve the desired shower outlet temperature (assuming the temperature of the hot water stored in the cylinder is held at a generally constant temperature e.g. 60° C.). The consumer will then adjust the position of the second plate 71 until the desired flow rate of mixed water leaving the shower is obtained.

Providing that the position of the first plate 70 remains unchanged we have found that the temperature of the water leaving the shower will remain substantially constant provided that there is no other change in external conditions i.e. the stored temperature of hot water remain substantially constant.

As shown the upper part 80 of the body 51 is externally threaded to receive an internally threaded flange 81 provided on the other end of the connector 17. A suitable sealing gasket 82 is located between the upper face 83 of the body 51 and the end face 84 of the connector 17 with suitable openings to permit the channels 60 and 61 to communicate with the annular 35 and to permit the cold water inlet pipe 27 to be connected to the outlet end 54 of the channel 52.

The body 51 itself is constructed in two portions, an uppermost portion 80 and a lowermost portion 85, the portions 80,85 being clamped together by a clamping ring 86 at an interface provided by a suitable sealing gasket 87 having suitable openings for the channels 52 and 53.

Figure 5:
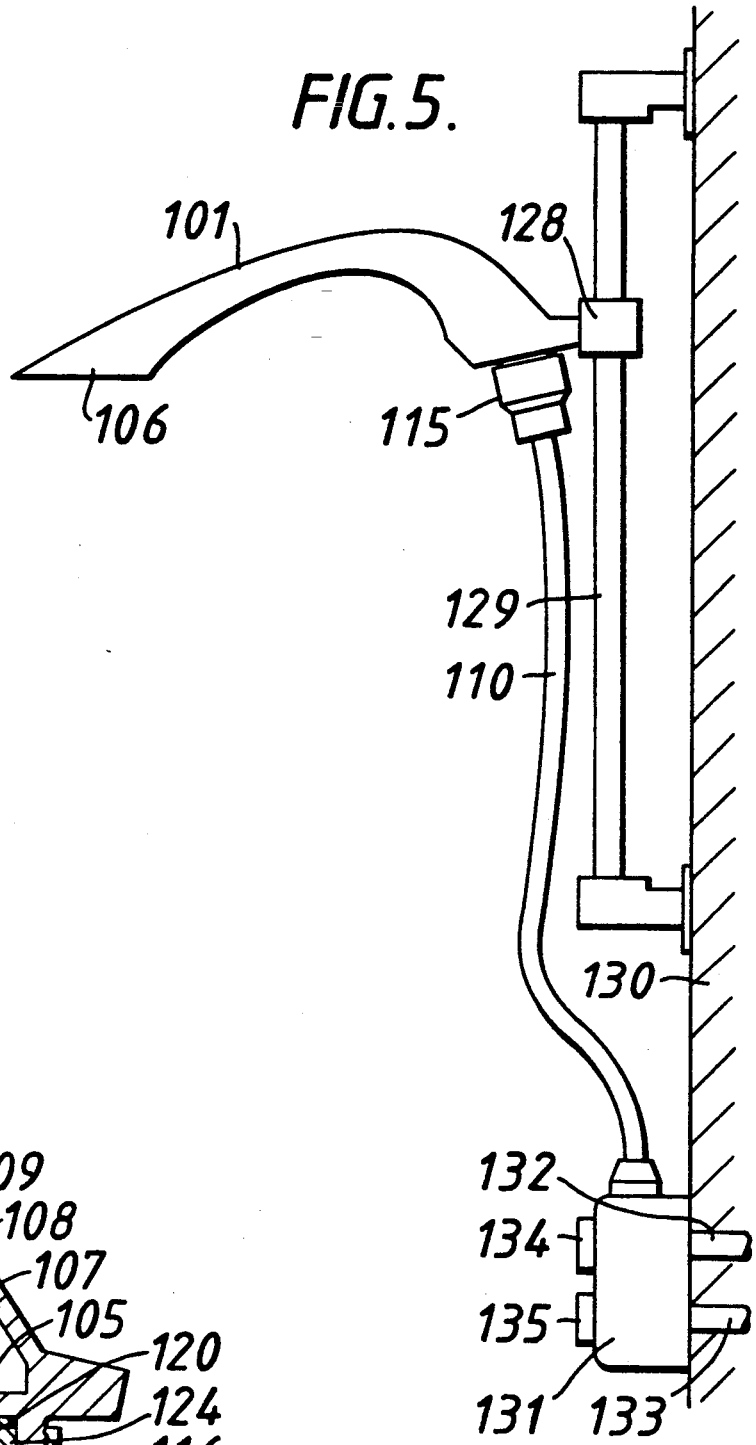
FIG. 5 is a side view of another embodiment of the shower unit.
Figure 6:
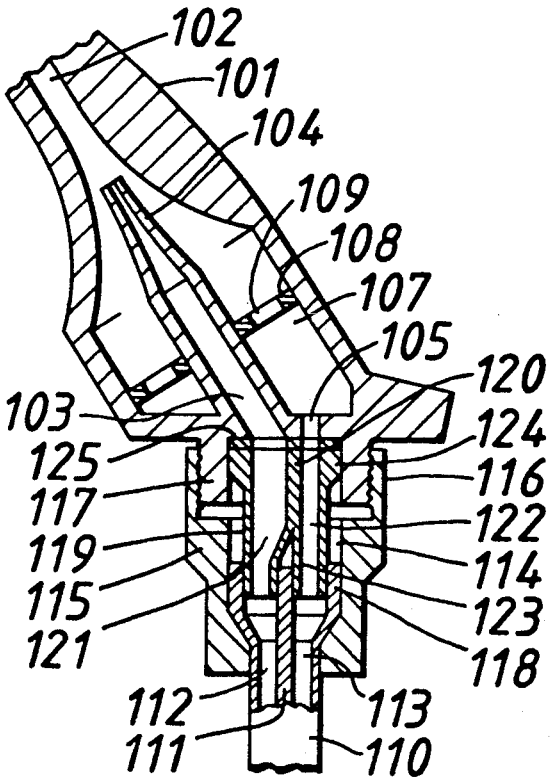
FIG. 6 is an axial section through the inlet end of the shower unit shown in FIG. 5.

Referring to FIGS. 5 and 6, in this version the shower unit comprises a body 101 in the form of a duct incorporating a mixing chamber 102 in which hot and cold water are mixed, an inlet 103 for cold water terminating in a tapering jet or nozzle 104 similar to that previously described for receiving the cold water from the inlet 103 and injecting the cold water into the chamber 102, an inlet 105 for hot water, the body 101 also incorporating a shower head or rose 106 as an integral part of the body 101.

The hot water inlet 105 leads into a settling chamber 107 which is separated from the mixing chamber 102 by a distribution plate 108 similar to plate 23 previously described, the cold water inlet 103 extending through a central aperture in the plate 108 and hot water reaching the mixing chamber 102 by means of several apertures 109 arranged in a circular array around the central aperture.

The bore of the settling chamber 107 tapers inwardly to meet the mixing chamber 102 into which cold water from the nozzle 104 is injected.

While not shown the mixing chamber leads to an outlet chamber formed by the shower head or rose 106 the bore of the outlet chamber tapering outwardly from the mixing chamber 102.

Hot and cold water is supplied to the unit by means of a flexible pipe 110 which may be made of a suitable plastics material, the pipe 110 being longitudinally partitioned by means of a divider 111 to form two separate segmental compartments 112 and 113, cold water being supplied by means of the left hand compartment 112 in FIG. 6 and hot water supplied by means of the right hand compartment 113.

The upper end of the pipe 110 leads into the bore 114 of a connector 115 for connecting the pipe 110 to the inlet end of the unit.

As shown in FIG. 6 the upper end of the connector 115 has an internally threaded circular portion 116 for connection to an externally threaded depending circular portion 117 at the inlet end of the unit while the upper end of the pipe 110 terminates in a flared portion 118 seated within a suitably shaped portion of the connector bore 114.

The pipe compartments 112 and 113 are respectively connected to the inlets 103 and 105 by means of a channel member 119 which is partly located within the bore of the connector 114 and partly within the depending inlet portion 117. The channel member 119 has a partition 120 forming separate longitudinal channels 121 and 122 respectively for connecting the cold water pipe compartment 112 to the cold water inlet 103 of the unit and for connecting the hot water pipe compartment 113 to the hot water inlet 105 of the unit.

As shown the bottom end of the channel member 119 is received within the flared portion 118 of the pipe 110 while the partition 120 is forked at its lower end 123 to fit over the pipe divider 111. The top end of the channel member 119 is provided with shoulders 124 forming a close fit with the inner wall of the depending inlet portion 117 of the unit. Seated on the top end of the channel member 119 is a gasket 125 to form a seal between the unit and the channel member 119, the gasket 125 having an aperture leading to the cold water inlet 103 and a further aperture leading to the hot water inlet 105.

Referring to FIG. 5, the body 1 has a bracket 128 by which the shower unit may be slidably mounted on a vertical bar 129 above a shower mat or bath, the bar 129 itself being mounted to the wall 130 of the bathroom. Thus the height of the shower head may be adjusted to suit the user's requirements.

As shown in FIG. 5 the lower end of the flexible pipe 110 leads into a valve unit 131 of a type similar to 50 previously described, the unit 131 being mounted on the wall 130 of the bathroom. A pipe 132 supplying hot water from the hot water cylinder (not shown) and a pipe 133 supplying mains pressure cold water extend through the wall into the valve unit 131 which then supplies the hot and cold water to the respective compartments of pipe 110. Rotatable knobs 134 and 135 instead of thumb wheels respectively control the flow rates of the hot and cold water in a manner similar to that previously described with reference to valve unit 50. As with that unit knob 134 controls the temperature of the water mixture and knob 135 its flow rate.

Figure 7:
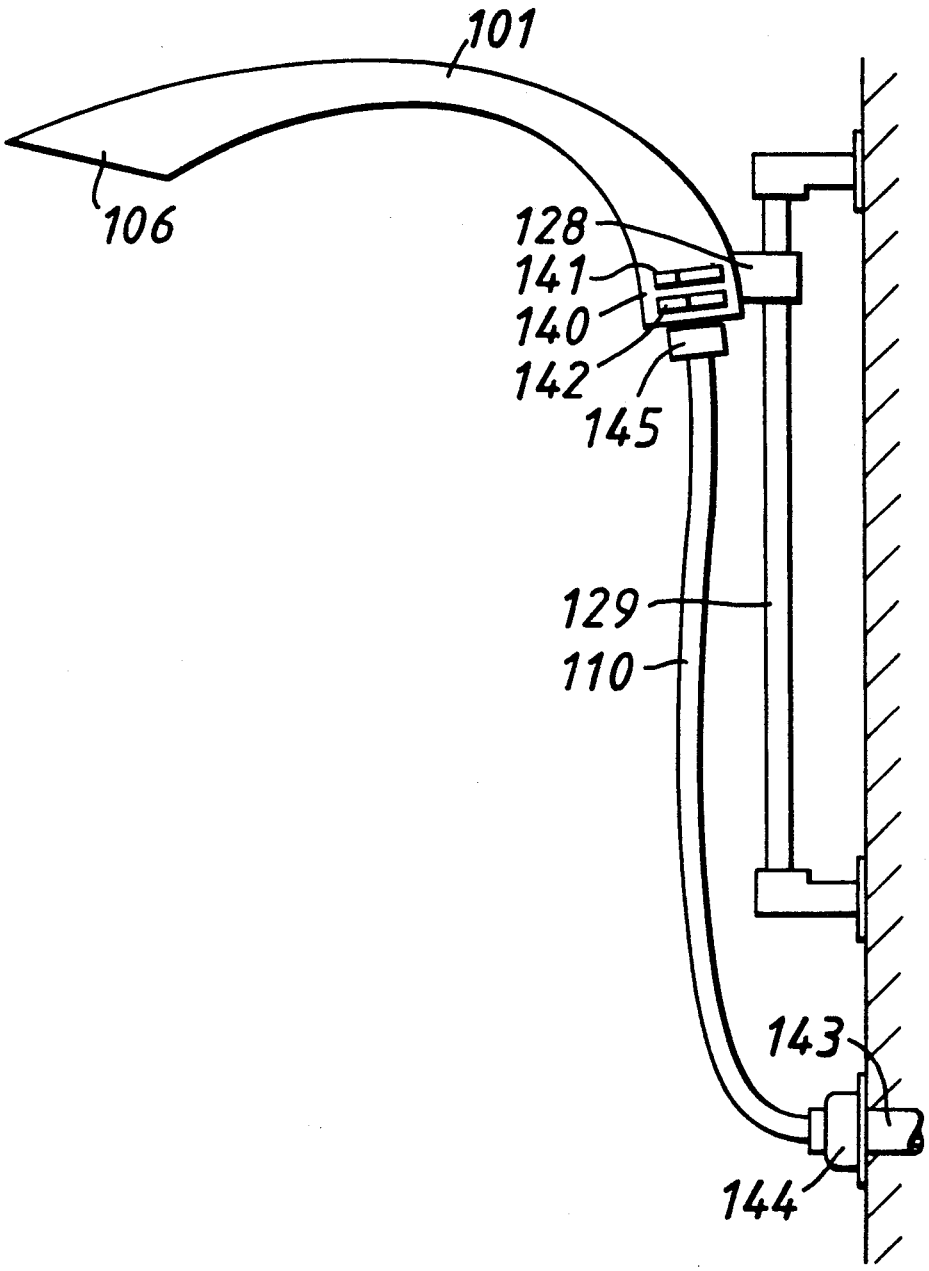
FIG. 7 is a side view of a still further embodiment of the shower unit.

Referring to FIG. 7 the interstices of this version of the unit are identical in construction to those of FIGS. 5 and 6 and parts identical to those shown in FIGS. 5 and 6 bear identical reference numerals, the valve unit 140 is housed within the body 101 of the shower unit and is similar in function to the valve unit 50 previously described. Thumb wheels 141 and 142 are respectively provided to set the temperature and flow rate of the water as previously described.

Mains pressure cold water is supplied through a first pipe (not shown) which is coaxially located within a second pipe 143 with which the first pipe forms a clearance for the flow of hot water from a storage cylinder, the pipes leading to a wall mounted connector 144 into which leads the lower end of the flexible pipe 110.

Within the connector cold water is directed into the left hand pipe compartment and hot water is directed into the right hand pipe compartment. The upper end of the flexible pipe 110 is connected to the valve 142 by means of a connector 145 similar to connector 115 previously described whereby cold water is directed into the cold water valve channel and hot water is directed into hot water valve channel for subsequent respective supply to the cold and hot water inlets in the body 101.

The shower body described i.e. mixing chamber and shower head can be made of any suitable plastics material by conventional mass production techniques such as injection moulding.

Since the units described obviates the need for a pipe for connecting the mixing chamber to the shower head the cost of the shower unit is lower than the conventional water entrainment shower units and moreover as previously explained can enable a more compact unit to be manufactured with little or no loss in delivery pressure.

As previously described the shower unit and valve system enable the temperature of the water at the shower outlet to be closely controlled and maintained at a substantially constant level over a relatively large range of flow rates e.g. between 2 and 10 liters/minute. Since the human body is extremely sensitive to small changes in water temperature this unusual feature is important to the provision of a comfortable shower in the situation where the water pressure may fluctuate as other users turn on the water supplies from the same source.

The valve system is designed to be connected to a large hot water cylinder storing gas-heated hot water at a temperature of between 50° C. and 70° C. most usually at about 60° C. with cold water delivered at a temperature of between 5° C. and 20° C. Due to stratification within the cylinder, hot water can be delivered at a constant temperature level for a long period before the stratification inside the cylinder is disrupted by the mixing of incoming cold water under induced force. This means that the user can enjoy a comfortable shower practically as long as it is desired.

The shower unit itself could be used to provide a powerful hot water jet cleaning device for say a car, hot water being more effective in removing grease, mud and other detritus than cold water.

It is envisaged that the unit could comprise two or more jets or nozzles connected to the cold water inlet pipe to enable the unit to be used in dwellings where the cistern is less than 0.5 meters above the cylinder e.g. in flats. Multiple jets would significantly increase the entrainment of the hot water by the cold water in the mixing chamber.

I claim:

1. A shower unit, comprising:

a shower head body having internally thereof a hollow passage extending from a first end of the body to an opposite second end of said body where one of a shower head and a rose is positioned, said passage being for the flow of water therealong and having a length dimension which is greater than any width dimension of the passage when said width dimension is measured at a right-angle to the direction of said water flow along said passage at any point along the water flow direction, said passage leading directly to said one of a shower head and rose at said second end of said body, said passage defining a mixing chamber between said first and second end of the body in which hot water supplied to the mixing chamber can be entrained by cold water supplied to said mixing chamber to form at least a partial mixture for discharging from said one of said shower head and rose, a jet disposed at said first end of the body and terminating within said mixing chamber, said jet having a convergent passage portion therein for accelerating a stream of water flowing through said jet and through which said jet, in use, cold water is injected into the mixing chamber to entrain said hot water from a supply introducing said hot water into the passage means at said first end, between said jet and the body, said hollow passage wholly surrounding a part of the length of said jet which is within said passage such that a hot water supply path is provided which wholly surrounds an entire length portion of said part of the length of said jet and wherein said body is self-supporting such that the body retains an originally formed shape thereof when held at said first end in a cantilever fashion, and a water distribution plate located at said first end of said body for surrounding and interconnecting said jet with said body at an upstream portion of said mixing chamber where said first end of said body is located, said water distribution plate having a plurality of apertures formed therein for flow of hot water therethrough into said mixing chamber.

2. A unit as claimed in claim 1, in which said one of said show head and rose comprises an integral part of said body containing said passage means.

3. A unit as claimed in claim 1 or 2, which comprises means for adjusting the height of said body and thereby the height of said one of said shower head and rose.

4. A unit as claimed in claim 1, which comprises a first valve for controlling the flow rate of hot water to the mixing chamber and a second valve for controlling the flow rate of cold water to the mixing chamber.

5. A unit as claimed in claim 4, wherein the second valve includes means for controlling the flow rate of hot water.

6. A unit as claimed in claim 5, which comprises a single body within which the valve means are contained.

7. A unit as claimed in claim 5, in which the first and second valves are positioned within the body containing the mixing chamber.

* * * * *